United States Patent [19]

Kunimoto et al.

[11] 4,310,100

[45] Jan. 12, 1982

[54] CONTAINER CAP HAVING A PEELABLE LINER

[75] Inventors: Go Kunimoto, Fujisawa; Isao Ichinose, Hiratsuka; Noboru Suzuki, Fujisawa; Fumio Mori, Yokohama, all of Japan

[73] Assignee: Toyo Seikan Kaisha Ltd., Tokyo, Japan

[21] Appl. No.: 90,627

[22] Filed: Nov. 2, 1979

[30] Foreign Application Priority Data

Nov. 2, 1978 [JP] Japan ..... 53-150373[U]

[51] Int. Cl.[3] ..... B65D 53/00

[52] U.S. Cl. ..... 215/228; 215/230; 215/347

[58] Field of Search ..... 215/228, 230, 341, 347, 215/343

[56] References Cited

U.S. PATENT DOCUMENTS

| | | | |
|---|---|---|---|
| 2,567,067 | 9/1951 | Grupp et al. . | |
| 3,312,005 | 4/1967 | McElroy . | |
| 3,361,281 | 1/1969 | Kehe . | |
| 3,557,987 | 1/1971 | Singer, Jr. . | |
| 3,633,781 | 1/1972 | Zapata . | |
| 4,111,323 | 9/1978 | Ichinose et al. | 215/347 X |

FOREIGN PATENT DOCUMENTS

| | | |
|---|---|---|
| 2178313 | 9/1978 | France . |

*Primary Examiner*—Donald F. Norton
*Attorney, Agent, or Firm*—Pennie & Edmonds

[57] ABSTRACT

A container cap having a coated metal shell. A peelable adhesive layer joins a liner to the shell. The peelable adhesive layer comprises a local coating resin layer having a diameter less than that of the metal shell and a layer of an epoxy resin.

10 Claims, 3 Drawing Figures

CONTAINER CAP HAVING A PEELABLE LINER

TECHNICAL FIELD

The present invention relates to a container cap having a peelable liner. More particularly, the invention relates to a container cap having an easily peelable liner and an interface layer joining the liner to a coated metal shell where the interface layer resists breaking up into small pieces and so forming objectionable dust particles during cap forming procedures.

BACKGROUND ART

Container caps in the form of crown caps or caps for wide mouth vessels have been formed in the past by coating a surface-protecting paint on a metal sheet, forming the coated metal sheet into a crown shell or cap shell and then bonding a liner or packing material to the interface of the formed shell.

In premium sales of bottled drinks and the like, there is often adopted a system in which a purchaser returns a predetermined number of liners or a liner having a win mark printed thereon in return for which a prize is sent to the purchaser. In crown shells or caps for use in such premium sales, it is important that a liner or packing should be easily peelable from the crown shell or cap. Furthermore, from the sanitary viewpoint, it is important that any printed surface of a liner be out of direct contact with the packed drink. Since a liner per se is usually applied to the interface of a crown shell or cap shell in a melted state, it is preferred that when a liner is peeled from a cap, that any ink layer applied to the crown shell or cap shall be transferred to the peeled liner.

In order to provide caps meeting the above requirements, usually a plurality of coating layers are formed on a metal sheet constituting a cap shell and peeling is effected in the interface between two coated layers. However, coating layers forming the easily peelable interface are readily broken into small pieces during the steps of press or draw forming of a metal sheet into a crown shell or cap shell, during transport of the crown or cap shells, during capping and so-called roll-on processing, all of which results in objectionable dust particles being formed. This phenomenon is not preferred from a sanitary viewpoint and it reduces the commercial value of products.

It is therefore an object of our invention to provide for a cap having an easily peelable liner and which will not form objectionable dust particles during processing steps.

DISCLOSURE OF INVENTION

Broadly a cap constructed according to our invention utilizes a peelable interface that is formed between a layer of a hydrocarbon resin or natural resin and a layer containing an epoxy resin. These two layers are applied on the inner facing surface of a coated metal sheet such that the hydrocarbon resin or natural resin layer has a local or limited area having a diameter less than that of the shell to be formed or of the liner to be fitted into the shell. By this means, a liner affixed to the layer containing the epoxy resin will have excellent peelability properties with respect to the epoxy layer and the layer forming the peelable interface will have excellent dust-resisting properties.

More specifically, in accordance with the present invention, there is provided a container cap having a peelable liner, which comprises a shell formed of a coated metal plate and a thermoplastic resin liner applied to the inner facing surface of the shell. The liner is bonded to the shell by way of a peelable adhesive interface between a layer composed of a hydrocarbon resin or natural resin which is applied locally to a limited area of the inner face of the shell so as to have a diameter less than that of the shell or the liner and a diameter greater than the peelable area of the liner. A layer containing an epoxy resin which is formed on the hydrocarbon resin or natural resin layer surrounds and overlies the layer of hydrocarbon or natural resins.

BEST MODE FOR CARRYING OUT THE INVENTION

Figure 1:
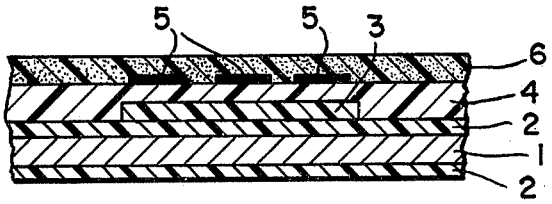
FIG. 1 is an enlarged sectional view illustrating a coated metal sheet prior to being formed into a crown or cap shell.

Referring to FIG. 1 there is illustrated the sectional structure of a coated metal sheet prior to being formed into a cap shell. Layers 2 of a known protecting paint are applied to both the surfaces of a metal substrate 1 which may comprise a tin-deposited steel plate or a tin-free steel plate (steel plate electrolytically treated with chromic acid). A peelable adhesive layer 3 of a hydrocarbon resin or natural resin is locally applied to the surface of the coated metal sheet to which a liner is to be applied. The shape and size of the layer 3 is limited so that the layer 3 has a diameter greater than that of the peelable portion of the liner to be applied and less than that of the metal shell.

A coating layer 4 containing an epoxy resin is applied on the entire surface of the layer 3 and a printing ink layer 5 having prize marks or indicia is formed on the layer 4 at a position corresponding to the local coating layer 3. An adhesive paint layer 6 is the applied on the printing ink layer 5.

Figure 2:
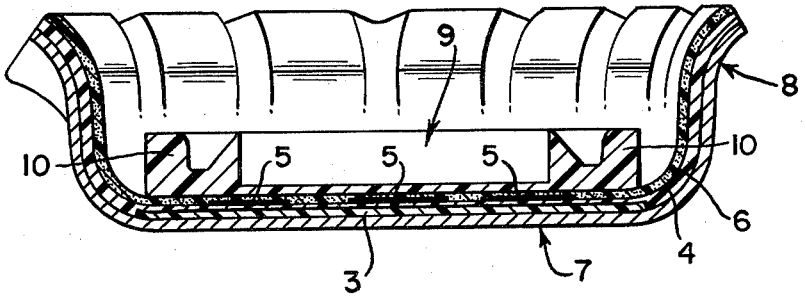
FIG. 2 is a sectional view illustrating a container cap constructed according to the invention in the form of a crown cap.

Referring to FIG. 2 a crown cap is illustrated formed from the above-mentioned coated metal sheet which has been punched and formed into a circular top portion 7 and a corrugated skirt 8. In the present invention, the local coating layer 3 composed of a hydrocarbon resin or natural resin is located on the inner side of the metal shell and has a diameter less than that of the top portion 7. This feature is very important in preventing formation of dust particles during processing operations.

A liner 9 of a synthetic resin is applied to the inner side of the top portion 7 of the crown shell and this liner 9 is bonded to the shell through an adhesive paint layer 6. The liner 9 may have a thick portion 10 providing good sealing of the liner 9 to the mouth of a container (not shown).

An important feature of the present invention resides in that the layer 3 composed of a hydrocarbon resin or natural resin forms an adhesive interface with the layer 4 comprising an epoxy resin to give a much better peelability characteristic than interfaces of known layer combinations. A further feature is that the combined portion of the resin layers 3 and 4 are locally applied on the inner side of the shell such that the diameter of the combined portion of the layers is less than that of the top portion 7 and greater than that of the liner 9. This prevents formation of dust particles during the steps of formation of the cap shell and during transportation, sealing and opening of the container cap.

In the instant specification and appended claims, the term "easily peelable adhesive interface" is defined as an interface between two layers which are bonded together to such an extent that they will not peel from each other during ordinary handling but may be easily peeled from each other by finger pressure. Ordinarily, this easily peelable adhesive interface has a peel strength in the range of 20 to 600 g/cm. In the present invention a layer 3 of a hydrocarbon resin or natural resin and an epoxy resin layer 4 will form such an easily peelable adhesive interface.

As pointed out hereinbefore, in conventional combined resin layers forming peelable adhesive interfaces, dust particles are formed in large quantities during processing and handling of the container caps. In the present invention, the combined resin layers 3 and 4 are formed on the inner side of the shell such that the diameter of the combined portions of the layers is less than that of the shell and greater than of the liner to be applied such that the underside of the liner forms a peelable portion of the liner. That is, the combined resin layers 3 and 4 are located in the top portion of the shell which is not bent, or only slightly bent, during forming of a cap shell. Accordingly, formation of dust particles can be prevented during press forming or draw forming of the metal sheet. Furthermore, the portion where the combined resin layers 3 and 4 are located is protected by the skirt 8 thus preventing breaking of the interface area and subsequent dust formation during handling and transportation of the cap prior to being applied to a container. This interface area is protected during sealing of a cap to a container by the liner 9 thus further reducing probability of formation of dust particles. A hydrocarbon resin or natural resin has a viscosity suitable for lithographic printing, relief printing, intaglio printing and screen printing. Accordingly an advantage of using these materials is that local coating to form the interface area can be accomplished very easily by printing.

When the liner 9 is peeled from a cap constructed according to the invention, the peripheral portion of the liner 9 is pressed by a nail or tool whereby peeling is initiated between the local coating layer 3 and the epoxy resin layer 4. This results in breakage occurring between the coating layer 4 and the layer 6 at the peripheral portion of the liner. Then, peeling is easily advanced in the interface between the layers 3 and 4. The, liner 9 is thus easily peeled from the top portion 7 of the shell in a state where the printing ink layer 5 will be transferred to the liner 9 with the portions of the layers 4 and 6 located radially inwardly of the liner remaining attached to the liner.

The resin constituting the local coating layer 3 should have a softening point (as measured according to the ring and ball method) lower than 180° C., and preferably lower than 120° C., in view of the adaptability to printing operations. Petroleum resins, coumarone-indene resins, terpene resins, rosin resins, rosin esters and modified rosin resins are especially preferred.

As petroleum resins, known products are obtained by heat-polymerizing a petroleum type unsaturated hydrocarbon such as cyclopentadiene or a higher olefinic hydrocarbon having 5 to 11 carbon atoms in the presence of a catalyst. In the present invention, any of these known petroleum resins may be used for formation of the coating layer 3. As the coumarone-indene resin, there are known resins having a relatively low degree of polymerization, which are obtained by polymerizing a tar fraction composed mainly of coumarone and indene (ordinarlly boiling at 160° to 180° C.) in the presence of a catalyst or under application of heat. Any of these known resins can be used in the present invention. As the terpene resin, there can be used synthetic and natural polymers of terpene type hydrocarbons, particularly resins obtained by polymerizing a terpene oil or nopinene fraction in the presence of a catalyst. As the rosin, there can be used so-called raw rosins such as gum rosin and wood rosin, rosin esters obtained by esterifying abietic acid in the rosin, such as rosin glycerin ester (ester gum), diethylene glycol diabietate, diethylene glycol 2-hydroxyabietate, rosin monoethylene glycol ester and rosin pentaerythritol ester. These rosins may be modified with known thermosetting resins or the like.

As the epoxy resin constituting the layer 4, there are employed polymeric compounds having at least two epoxy compounds in the molecule, precondensates thereof and their combinations with low-molecular-weight or high-molecular-weight curing agent compounds having a reactivity with epoxy groups.

Ordinarily, an epoxy resin formed by condensing epichlorohydride with a polyhydric phenol is preferably employed. An epoxy resin of this type has a molecular structure represented by the following formula:

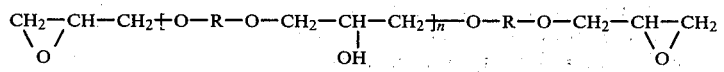

(1)

wherein n is 0 or a positive integer, particularly an integer of up to 12, and R stands for the hydrocarbon residue of a polyhydric phenol.

As the polyhydric phenol, there can be used dihydric phenols (HO—R—OH) such as 2,2-bis(4-hydroxyphenyl) propane (bisphenol A), 2,2-bis(4-hydroxyphenyl)-butane (bisphenol B), 1,1'-bis(4-hydroxyphenyl)ethane and bis (4-hydroxyphenyl)methan (bisphenol F). Bisphenol A is especially preferred. A precondensate of phenol and formaldehyde may be used as the polyhydric alcohol.

In order to attain the objects of the present invention, it is preferred that an epoxy resin having an epoxy equivalent of 140 to 4000, particularly 200 to 2500, be used as the resin component.

The curing agent to be used in combination with the epoxy resin component comprises polyfunctional compounds having a reactivity with epoxy groups, such as polybasic acids, acid anhydrides, polyamines and polyamides. As preferred examples, there can be mentioned ethylene diamine, diethylene triamine, triethylene tetramine, methaphenylene diamine, 4,4'-diaminodiphenylmethane, 4,4'-diaminodiphenylsulfone, 4,4'-diaminodiphenylether, dimer acid polyamides, adipic hydrazide, oxalic acid, phthalic anhydride, maleic anhydride, hexahydrophthalic anhydride, pyromellitic dianhydride, cyclopentadiene-methyl maleate adduct, dodecylsuccinic anhydride, dichloromaleic anhydride and chlorendic anhydride.

The curing agent is used in an amount of 2 to 150 parts by weight, preferably 20 to 60 parts by weight, per 100 parts by weight of the epoxy resin component (all "parts" and "%" given hereinafter are by weight unless otherwise indicated).

In accordance with one preferred embodiment of the present invention, a mixture of an epoxy resin component as mentioned above and at least one thermosetting resin selected from the group consisting of resol type phenol-formaldehyde resins, urea-formaldehyde resins and melamine-formaldehyde resins is used for formation of the layer 4. The mixing ratio of the two resin components can be changed in a broad range. Ordinarily, it is preferred that the mixing ratio of the epoxy resin to the thermosetting resin be in the range of from 5/95 to 95/5, especially 40/60 to 90/10. The epoxy resin and thermosetting resin may be used in the form of a blend for formation of the coating layer 4 or they may be used after they have been precondensed.

In view of processability and corrosion resistance, a vinyl resin is preferred for formation of the protecting layer 2. As the vinyl resin, a copolymer of (a) vinyl chloride is mixed with (b) at least one ethylenically unsaturated monomer selected from vinyl acetate, vinyl alcohol, vinyl acetal, acrylic acid, methacrylic acid, maleic acid, fumaric, itaconic acid, alkyl acrylates, alkyl methacrylates and vinylidene chloride. The mixing ratio of vinyl chloride (a) to other ethylenically unsaturated monomer (b) may be changed in a broad range. Ordinarily, however, it is preferred that the mixing molar ratio (a)/(b) be in the range of from 95/5 to 60/40, particularly from 90/10 to 70/30. The molecular weight of the vinyl resin is not particularly critical provided that the vinyl resin has a film-forming molecular weight. As preferred examples of the vinyl resin, there can be mentioned a vinyl chloride-vinyl acetate copolymer, a partially saponified vinyl chloride-vinyl acetate copolymer, a partially saponified and partially acetalized vinyl chloride-vinyl acetate copolymer, a vinyl chloride-vinyl acetate-maleic anhydride copolymer and a vinyl chloride-vinylidene chloride-acrylic acid copolymer.

Furthermore, an epoxy resin, an amino resin, a phenolic resin, an acrylic resin and a vinyl butyral resin may be used singly or in the form of a mixture of two or more of them. These resins may be used in combination with the above-mentioned vinyl resins.

A synthetic resin having appropriate cushioning and sealing properties, for example, an olefin resin such as polyethylene, an ethylene-vinyl acetate copolymer or an ethylene-propylene copolymer or a soft vinyl chloride resin, is used as the liner 9. As the adhesive paint layer 6, an acid-modified olefin resin or oxidized polyethylene is used for an olefin type resin liner, and a vinyl resin paint such as mentioned above or an acrylic resin paint is used for a vinyl chloride resin liner.

For formation of the liner 9, in view of the adaptability to the forming operation, there is preferably adopted a method in which a thermoplastic resin is extruded in a cap shell and shaping of a liner and heat bonding are simultaneously performed by mold pressing, or a method in which a flowable composition such as a plastisol is supplied into a shell and the composition is spread by a centrifugal force to form a liner. Furthermore, there may be adopted a method in which a disc liner is formed outside a shell and it is bonded to the top portion of the shell.

Figure 3:
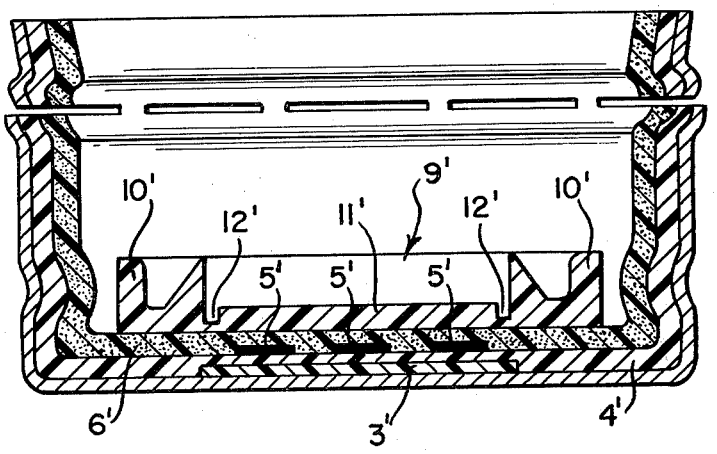
FIG. 3 is a sectional view illustrating a container cap constructed according to the invention in the form of a pilfer-proof cap.

The container cap of the present invention may be formed in a so-called liner-provided cap. In this embodiment, as shown in FIG. 3, the liner 9' comprises a thick sealing portion 10' and a thin central portion 11' and a completely cut line or breakable weakened line 12' is formed in the boundary between the two portions 10' and 11' so that only the central portion 11' of the liner 9' forms a peelable portion which is peeled off. Accordingly, even after peeling of the liner, the cap still retains the sealing property.

The local coating layer 3' of a hydrocarbon resin or natural resin may be formed so that it covers the entire surface of the liner or, it may be formed only on the central portion of the liner.

The structure and effect of the present invention will now be described with reference to the following Examples.

EXAMPLE 1

A 30% solution of a vinyl chloride-vinyl acetate copolymer (VMCH® manufactured by UCC) in a mixed solvent containing equal amounts of methyl cellosolve and methylethyl ketone was roll-coated as an undercoat paint on both the surfaces of an aluminum plate having a thickness of 0.25 mm so that the dry thickness of the coating was 6μ, and the coating was heated and baked at 190° C. for 10 minutes.

A circular trademark having an outer diameter of 70 mm was printed on one surface of the surface-coated plate by using an ordinary metal printing ink. Then, an epoxy ester type paint was coated in a thickness of 5μ on the printed surface and the coating was dried.

On the other surface of the coated plate, a circular print layer having an outer diameter of 26 mm and a thickness of 3μ was formed with a mineral spirit solution (solid content =75%) of a hydrocarbon resin (Hi-Lez P-100 manufactured by Mitsui Petrochemical) by using a printing machine so that the center of the print layer was in agreement with the center of the above-mentioned printed trademark, and the print layer was heated and dried at 180° C. for 10 minutes. Then, an epoxy-amino resin paint (a 30% solution of 90 parts of Epikote® #1009 manufactured by Shell and 10 parts of Becramine® 138 manufactured by Nippon Reichhold mixed in equal amounts of Solvesso #100 and methylethyl ketone) was roll-coated in a thickness of 2μ on the hydrocarbon resin-printed surface and baked and cured at 190° C. for 10 minutes.

A prize mark was printed on the epoxy-amino resin coating layer in a circular area having an outer diameter of about 26 mm by using an ordinary metal ink so that the prize mark was located at the same position as that of the lower hydrocarbon resin layer, and the printed part was cured. Finally, an epoxy paint containing 20% of oxidized polyethylene (a xylene solution of a mixture formed by incorporating oxidized polyethylene having a density of 0.98and a softening point of 132° C. into a 90/10 blend of Epikote #1007/phenol-formaldehyde resin) was coated in a thickness of 5μ entirely on the prize mark-printed surface and heated and cured at 190° C. for 10 minutes. Thus, a coated aluminum plate having printed areas on both the surfaces was prepared. The coated plate was punched into a cylinder so that the prize mark-printed surface was located inside and the centers of the printed areas were in agreement with the center of the resulting cap and a perforation cut line was formed. Thus, a roll-on pilfer-proof cap shell having an inner diameter of 38 mm and a height of 17 mm was prepared.

Molten low density polyethylene having a melt index of 7 was supplied on the inner face of the cap shell in an amount of 0.6 g per cap and punched by cooled press-forming punch to form a cap shell having a polyethylene liner in the shape as shown in FIG. 3. The outer diameter of the cap shell was 36 mm and the diameter of the portion to be peeled was 25 mm.

The cap was tested with respect to processability (formation of dusts at the cap forming step and the punching step), liner bonding property (falling or sticking of the liner at the hoppering test) and liner peelability (peelability of the liner from the cap after it was separated from a glass bottle to which the cap had been sealed). Obtained results are shown in Table 1.

COMPARATIVE EXAMPLE 1

A coated plate was prepared in the same manner as described in Example 1 except that the hydrocarbon resin was printed on the entire surface of the plate, and a cap shell was prepared from this coated plate in the same manner as described in Example 1. The cap was tested with respect to the items described in Example 1. Obtained results are shown in Table 1.

COMPARATIVE EXAMPLE 2

A coated aluminum plate was prepared in the same manner as described in Example 1 except that the hydrocarbon resin was not printed on the plate. A cap shell was formed from this coated plate in the same manner as described in example 1 and was tested in the same manner as in Example 1 to obtain results shown in Table 1.

COMPARATIVE EXAMPLE 3

A coated aluminum plate was formed in the same manner as described in Example 1 except that polyethylene wax was used instead of the hydrocarbon resin used in Example 1. A cap shell was prepared from this coated plate in the same manner as described in Example 1 and tested in the same manner as in Example 1 to obtain results shown in Table 1.

EXAMPLE 2

A base coat layer (epoxy-amino resin paint), a trademark print and an overcoat layer (epoxy ester paint) were formed on one surface (the outer face of the resulting crown) of a surface-treated steel plate having a thickness of 0.25 mm (Hi-Top® manufactured by Toyo Kohan), and an anti-corrosive lacquer comprising 70 parts of a vinyl chloride-vinyl acetate copolymer, 25 parts of a bisphenol type epoxy resin and 5 parts of an amino resin (butylated urea resin) in an organic solvent was roll-coated on the other surface (inner face of the resulting crown) so that the thickness after drying and curing was 3μ. The plate was then heated at 190° C. for 10 minutes. A kerosine solution (solid content =40%) of a natural resin (rosin) was coated on the anti-corrosive lacquer layer in a thickness of 5μ (1) on the entire surface of the anti-corrosive lacquer layer, (2) on a circular area having an inner diameter of 26 mm or (3) on a circular area having an inner diameter of 28 mm and heated and dried at 180° C. for 10 minutes.

An epoxy-phenolic paint (a 33% solution of a 90/10 blend of Epikote #1009/resol type phenolic resin in a mixed solvent of xylene and isobutyl ketone) was roll-coated on the entire surface of the so-formed natural resin layer so that the thickness after drying was 3μ and heated at 190° C. for 10 minutes to form a coating layer.

A prize mark was printed on the so-formed epoxy-phenolic resin layer only in the area where the natural resin layer was present below by using an ordinary metal printing ink of the alkyd resin type and the printed prize mark was dried. A mixture formed by incorporating 20% of oxidized polyethylene having a density of 1.0 and a softening point of 135° C. into the above-mentioned epoxy-phenolic resin paint was coated as an adhesive entirely on the inner face (thickness =6μ) and heated at 190° C. for 10 minutes to form a coated plate having printed areas on both the surfaces.

The printed coated plate was formed into a crown shell having an inner diameter of 26 mm by crown forming press so that the prize mark-printed surface was located inside and the center of the circular natural resin coating layer having an inner diameter of 26 or 28 mm was in agreement with the center of the top portion of the crown shell.

A molten mass of low density polyethylene having a melt index of 7 and a density of 0.92 was supplied to the inner face of the crown shell in an amount of 0.25 g per shell, and punched by a cooled forming punch to form a crown shell having a polyethylene liner having an outer diameter of 26 mm.

The crown shell was tested with respect to processability (formation of dusts at the pressing, punching and capping steps), liner bonding property (falling or sticking of the liner on hoppering at the capping step) and liner peelability (peelability of the liner from the opened crown which had been sealed to a bottle). The results obtained are shown in Table 2.

For comparison, a crown shell was prepared in the same manner as described above except that the natural resin layer was not formed at all, and the crown shell was similarly tested. Obtained results are shown in Table 2.

TABLE 1

| Sample | Amount (mg) of Formed Dusts[1)] cap forming | punching | Liner Bonding Property | Liner Peelability[2)] (g/cm) | Re-sealing Property[3)] | Remarks |
|---|---|---|---|---|---|---|
| Example 1 | 1 | 0 | | 450 | | prize mark was transferred to liner |
| Comparative Example 1 | 150 | 102 | Δ- X | 300 | X | entire liner was peeled |
| Comparative Example 2 | 3 | 0 | | not peelable[4)] | — | |
| Comparative Example 3 | 85 | 73 | X | measurement | X | liner often dropped |

TABLE 1-continued

| Sample | Amount (mg) of Formed Dusts[1] cap forming | punching | Liner Bonding Property | Liner Peelability[2] (g/cm) | Re-sealing Property[3] | Remarks |
|---|---|---|---|---|---|---|
| | | | | impossible[5] | | |

Note
[1] Amount (mg) of dusts (pieces of coatings) formed in 100 caps at each step
[2] Peel strength (g/cm) of liner from cap
[3] Sealing property of cap after peeling of liner
[4] Liner could not be peeled because of too strong bonding
[5] liner was peeled before measurement because of too weak bonding
: good
Δ: ordinary
X: bad

TABLE 2

| Crown Shell | Amount (g) of Dust Formed pressing | capping | Liner Bonding Property | Liner Peelability (g/cm) | Remarks |
|---|---|---|---|---|---|
| natural resin layer 26 mm in diameter | 1 | 0 | | 430 | prize mark was transferred to liner |
| natural resin layer 28 mm in diameter | 36 | 27 | Δ | 270 | prize mark was transferred to liner |
| natural resin layer coated on entire surface | 102 | 89 | X | 250 | prize mark was transferred to liner |
| natural resin layer not coated | 2 | 0 | | not peelable | |

We claim:

1. A container cap comprising a metal shell, a thermoplastic resin peelable liner on the inside of said shell, a peelable adhesive layer having a diameter less than that of said metal shell and larger than that of a peelable portion of the liner, and an epoxy resin coating layer secured to said liner overlying the inside surface of said metal shell and said peelable adhesive layer to form an easily peelable adhesive interface with said peelable adhesive layer whereby pressing the periphery of the liner overlying said inner face will cause a break in the epoxy resin layer to allow easy peeling of the liner from the shell at the interface.

2. A container cap according to claim 1 wherein said peelable adhesive layer has a softening point below 180° C.

3. A container cap according to claim 1 wherein said peelable adhesive layer comprises a hydrocarbon resin.

4. A container cap according to claim 3 wherein said hydrocarbon resin comprises a petroleum resin.

5. A container cap according to claim 3 wherein said hydrocarbon resin layer comprises a coumarone-indene resin.

6. A container cap according to claim 1 wherein said peelable adhesive layer comprises a natural resin.

7. A container cap according to claim 6 wherein said natural resin comprises a rosin.

8. A container cap according to claim 6 wherein said natural resin comprises a rosin ester.

9. A container cap according to claim 6 wherein said natural resin comprises a terpene resin.

10. A container cap according to claim 1 wherein said peelable adhesive layer is formed by printing.

* * * * *

UNITED STATES PATENT AND TRADEMARK OFFICE

CERTIFICATE OF CORRECTION

PATENT NO. : 4,310,100

DATED : January 12, 1982

INVENTOR(S) : Go Kunimoto et al

It is certified that error appears in the above—identified patent and that said Letters Patent is hereby corrected as shown below:

Columns 8 and 9, Tables 1 and 2 should appear as follows:

TABLE 1

| Sample | Amount (mg) of Formed Dusts[1] cap forming | Amount (mg) of Formed Dusts[1] punching | Liner Bonding Property | Liner Peelability[2] (g/cm) | Re-sealing Property[3] | Remarks |
|---|---|---|---|---|---|---|
| Example 1 | 1 | 0 | O | 450 | O | prize mark was transferred to liner |
| Comparative Example 1 | 150 | 102 | Δ-X | 300 | X | entire liner was peeled |
| Comparative Example 2 | 3 | 0 | O | not peelable[4] | — | |
| Comparative Example 3 | 85 | 73 | X | measurement impossible[5] | X | liner often dropped |

Note
[1] Amount (mg) of dusts (pieces of coatings) formed in 100 caps at each step
[2] Peel strength (g/cm) of liner from cap
[3] Sealing property of cap after peeling of liner
[4] Liner could not be peeled because of too strong bonding
[5] liner was peeled before measurement because of too weak bonding
O: good
Δ: ordinary
X: bad

UNITED STATES PATENT AND TRADEMARK OFFICE

CERTIFICATE OF CORRECTION

PATENT NO. : 4,310,100

DATED : January 12, 1982

INVENTOR(S) : Go Kunimoto et al

It is certified that error appears in the above—identified patent and that said Letters Patent is hereby corrected as shown below:

TABLE 2

| Crown Shell | Amount (g) of Dust Formed | | Liner Bonding Property | Liner Peelability | |
|---|---|---|---|---|---|
| | pressing | capping | | (g/cm) | Remarks |
| natural resin layer 26 mm in diameter | 1 | 0 | O | 430 | prize mark was transferred to liner |
| natural resin layer 28 mm in diameter | 36 | 27 | Δ | 270 | prize mark was transferred to liner |
| natural resin layer coated on entire surface | 102 | 89 | X | 250 | prize mark was transferred to liner |
| natural resin layer not coated | 2 | 0 | O | not peelable | |

Signed and Sealed this

*Twentieth* Day of *April 1982*

[SEAL]

*Attest:*

GERALD J. MOSSINGHOFF

*Attesting Officer*

*Commissioner of Patents and Trademarks*